US011043766B2

(12) United States Patent
Chen et al.

(10) Patent No.: US 11,043,766 B2
(45) Date of Patent: Jun. 22, 2021

(54) ELECTRICAL MALE TERMINAL, AND METHODS FOR CONNECTING THEREOF

(71) Applicant: J.S.T. CORPORATION, Farmington Hills, MI (US)

(72) Inventors: Ping Chen, Novi, MI (US); Gwendolyn Upson, Ypsilanti, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/828,291

(22) Filed: Mar. 24, 2020

(65) Prior Publication Data

US 2021/0066835 A1 Mar. 4, 2021

Related U.S. Application Data

(60) Provisional application No. 62/893,679, filed on Aug. 29, 2019.

(51) Int. Cl.
*H01R 13/05* (2006.01)
*H01R 13/11* (2006.01)
(Continued)

(52) U.S. Cl.
CPC ..... *H01R 13/052* (2013.01); *H01R 11/18* (2013.01); *H01R 13/111* (2013.01); *H01R 13/5829* (2013.01); *H01R 2101/00* (2013.01)

(58) Field of Classification Search
CPC .... H01R 4/2404; H01R 4/26; H01R 13/4223; H01R 13/432; H01R 13/052;
(Continued)

(56) References Cited

U.S. PATENT DOCUMENTS 4,046,450 A * 9/1977 Yurtin ..... H01R 13/428 439/746
5,266,056 A 11/1993 Baderschneider
(Continued)

OTHER PUBLICATIONS

International Search Report for International Application No. PCT/US2020/048364 dated Nov. 20, 2020 (3 sheets).
(Continued)

*Primary Examiner* — Gary F Paumen
(74) *Attorney, Agent, or Firm* — Kratz, Quintos & Hanson, LLP

(57) ABSTRACT

An electrical male terminal of this invention includes a clamp or crimp area, a main body, and a blade. A tang member having a lever member, locks with a connector assembly. Protruding members and support members of the main body act as overstress protection. The main body includes a tapered portion, a protruding guide member, and a panel shield member to guide the electrical male terminal, the panel shield member protecting the protruding guide member. The polarity of the electrical male terminal is such that the upper portion of the main body in the upper portion of the connector assembly is narrower than the lower portion of the main body in the lower portion of the connector assembly. Also, this invention includes methods for securing a wire or cable with the electrical male terminal, using a pair of wire-insulation clamping tabs or insulation crimp wing portions, and a pair of wire-clamping tabs or core crimp wing portions.

12 Claims, 18 Drawing Sheets

(51) Int. Cl.
*H01R 13/58* (2006.01)
*H01R 11/18* (2006.01)
*H01R 101/00* (2006.01)

(58) Field of Classification Search
CPC ... H01R 13/111; H01R 13/5829; H01R 11/18; H01R 2101/00
USPC ..... 439/746, 752.5, 426
See application file for complete search history.

(56) References Cited

U.S. PATENT DOCUMENTS 6,217,379 B1 * 4/2001 D'Hulster ..... H01R 13/04 439/752.5
6,238,252 B1 * 5/2001 Flieger ..... H01R 13/04 439/746
6,390,860 B2 * 5/2002 Shirouzu ..... H01R 13/04 439/595
6,572,417 B2 * 6/2003 Katsuma ..... H01R 13/04 439/752.5
6,755,696 B1 * 6/2004 Ko ..... H01R 13/432 439/746
6,997,761 B2 * 2/2006 Lutsch ..... H01R 13/17 439/866
7,635,286 B1 * 12/2009 Morello ..... H01R 13/41 439/752.5
7,950,972 B1 5/2011 Chen
9,022,818 B2 * 5/2015 Onuma ..... H01R 4/188 439/877
2005/0118884 A1 * 6/2005 Lutsch ..... H01R 13/17 439/746
2015/0140876 A1 5/2015 Lehner et al.
2016/0240936 A1 8/2016 Yudate
2017/0155205 A1 6/2017 Zhang et al.
2018/0151997 A1 5/2018 Busies et al.

OTHER PUBLICATIONS

Written Opinion of the International Searching Authority for International Application No. PCT/US2020/048364 dated Nov. 20, 2020 (8 sheets).

* cited by examiner

ELECTRICAL MALE TERMINAL, AND METHODS FOR CONNECTING THEREOF

CROSS-REFERENCE TO RELATED APPLICATIONS

This patent application claims priority to U.S. Provisional Patent Application No. 62/893,679 filed Aug. 29, 2019, which is hereby incorporated herein by reference in its entirety.

BACKGROUND OF THE INVENTION

It is desired that an electrical male terminal be provided with structural arrangements or features for overstress protection and guide-assist to efficiently protect and guide the electrical male terminal, and thereby prevent undesired deformation of the electrical male terminal during mating thereof with a connector assembly.

It is further desired to ensure that orientations or polarities of the electrical male terminal of this invention and a corresponding connector assembly be maintained for proper fitting therewith.

It is also desired that a method be provided in this invention for ensuring effective grip of an electrical wire or cable by the electrical male terminal of this invention by including thereof a pair of wire-clamping tabs or core crimp wing portions that are clamped or folded, and crimped onto an inserted wire core portion of an electrical wire or cable to prevent the electrical wire or cable from slipping within or away from the electrical male terminal.

It is also desired that a method be provided in this invention for ensuring effective grip of the electrical wire or cable by the electrical male terminal of this invention by including thereof a pair of wire-insulation clamping tabs or insulation crimp wing portion that are deformed, clamped or folded, and crimped onto an inserted insulation portion of the electrical wire or cable to prevent the electrical wire or cable from slipping within or away from the electrical male terminal.

SUMMARY OF THE INVENTION

This invention provides the electrical male terminal for mating with a connector assembly, and generally includes a clamp or crimp area, a main body, and a blade.

The clamp or crimp area includes a pair of wire-insulation clamping tabs or insulation wing portions, and a pair of wire-clamping tabs or core crimp wing portions. For ensuring a secured contact and grip with an electrical wire or cable, the pair of wire-clamping tabs or core crimp wing portions include, at an electrical wire or cable contact surface thereof, multiple substantially elongated notches and protruding members. The pair of wire-clamping tabs or core crimp wing portions is deformed, clamped or folded, and crimped onto the core portion of the electrical wire or cable. Further, the pair of wire-insulation clamping tabs or insulation crimp wing portions is also respectively deformed, clamped or folded, and crimped onto the insulation portion of the electrical wire or cable. The front portion of the clamp or crimp area has a neck member which transitions to the main body of the male terminal.

The main body is substantially box-shaped, and generally includes a tang member. The tang member includes a lever member which locks the electrical male terminal with the connector assembly. The lever member has a protruding member, which meets another protruding member extending from the main body, when the lever member is flexed. Both protruding members act as an overstress protection for the lever member; i.e., to prevent or protect the lever member from becoming deformed when the male terminal is being mated with the connector assembly.

A protruding guide member protrudes from and is attached to the tang member. A front end portion of the main body also includes a tapered portion. The front end portion of the main body further includes a panel shield member for protecting the protruding guide member. The tapered portion, along with a protruding guide member and panel guide member, of the main body, assist in guiding the male terminal of this invention when mated with the connector assembly. The front end portion of the main body transitions into a blade having a tip thereof that is also tapered. The main body further includes support members at either end thereof.

The electrical male terminal of this invention also has an orientation or polarity for proper fitment into the corresponding connector assembly, having an orientation or polarity which is also maintained for proper fitting with the electrical male terminal.

BRIEF DESCRIPTION OF THE DRAWINGS

FIG. 4C shows a cross-sectional view of a floor of the wire-clamping tabs or core crimp wing portions as substantially flat in shape, while

FIG. 8A is a front elevational view of the male terminal of this invention, while

DETAILED DESCRIPTION OF THE PREFERRED EMBODIMENTS

Figure 1A:
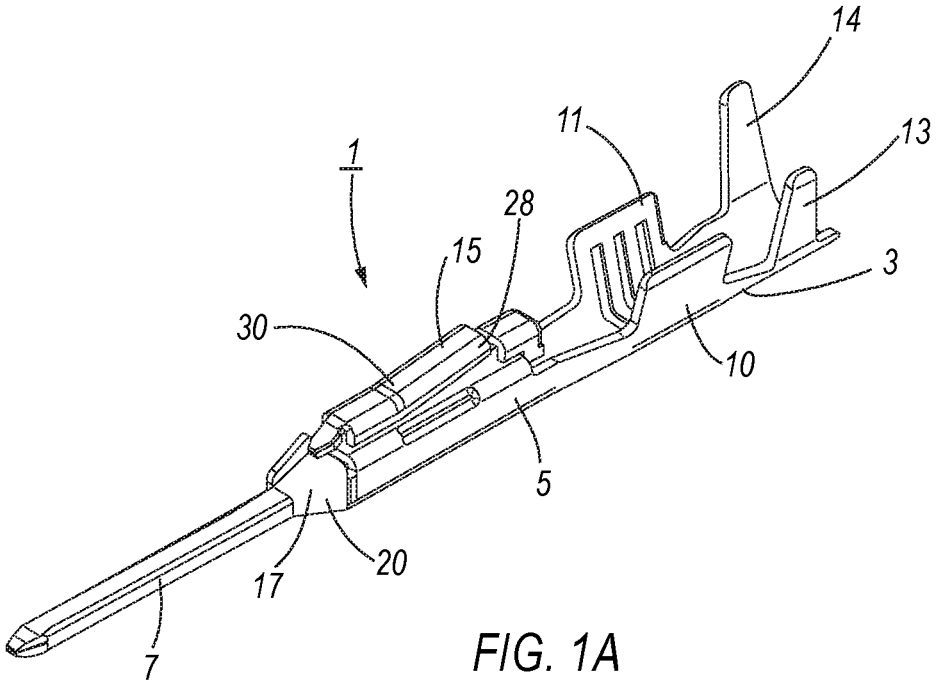
FIG. 1A is a front top perspective view of the electrical male terminal of this invention.
Figure 1B:
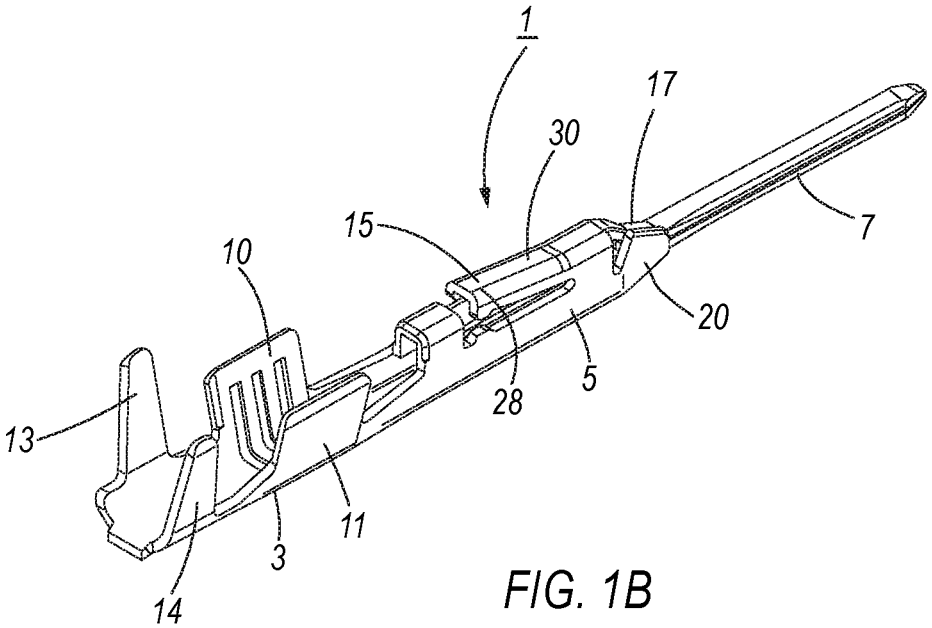
FIG. 1B is a back top perspective view of the electrical male terminal of this invention.

FIG. 1 shows a front top perspective view of the electrical male terminal, generally referred to as reference number 1. The electrical male terminal 1 includes a clamp or crimp area 3, a main body 5, and a blade 7 integrally formed in a lengthwise direction. As more fully discussed later, the clamp or crimp area 3 includes a pair of wire-clamping tabs or core crimp wing portions 10, 11, and a pair of wire-insulation clamping tabs or insulation crimp wing portions 13, 14. The main body 5 includes a tang member 15 as well as a tapered portion 17 at a front end portion 20 thereof. The tapered portion 17 narrowly tapers towards the blade 7. Similarly shown in the back top perspective view of the male terminal 1 in FIG. 1B, is the clamp or crimp area 3, including the pair of wire-clamping tabs or core crimp wing portions 10, 11 and the pair of wire-insulation clamping tabs or insulation crimp wing portions 13, 14. Also similarly shown in FIG. 1B in the back top perspective view of the electrical male terminal 1, as in FIG. 1A, are the tang member 15 and the tapered portion 17 at the front end portion 20 of the main body 5. It is preferable that the main body 5 has a shape or form that is substantially boxed-shape or the like, although the shape or form thereof is not restricted thereto.

Figure 2A:
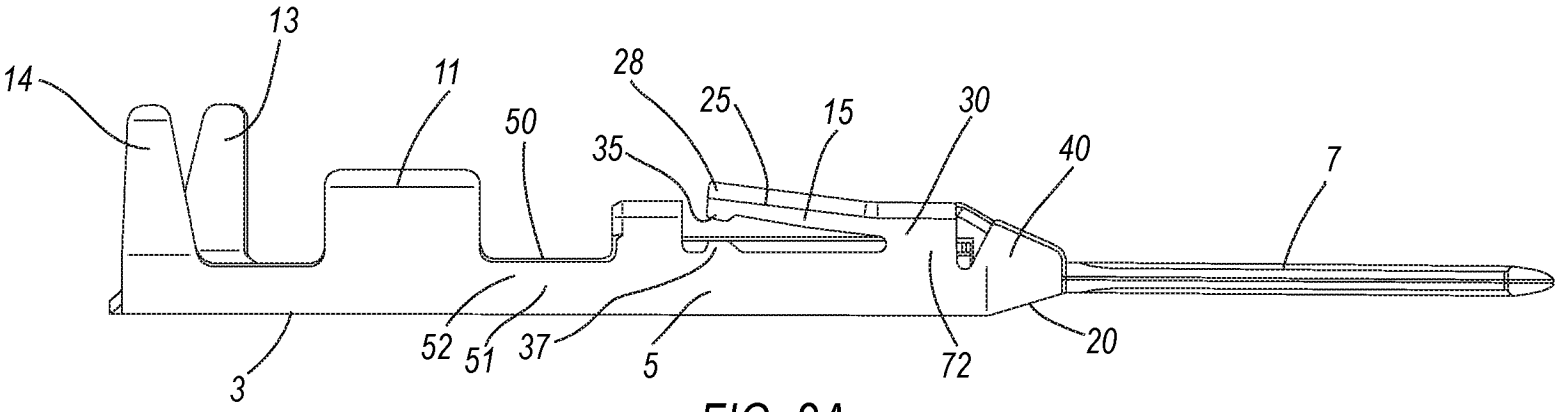
FIG. 2A is right side elevational view of the electrical male terminal of this invention.
Figure 2B:
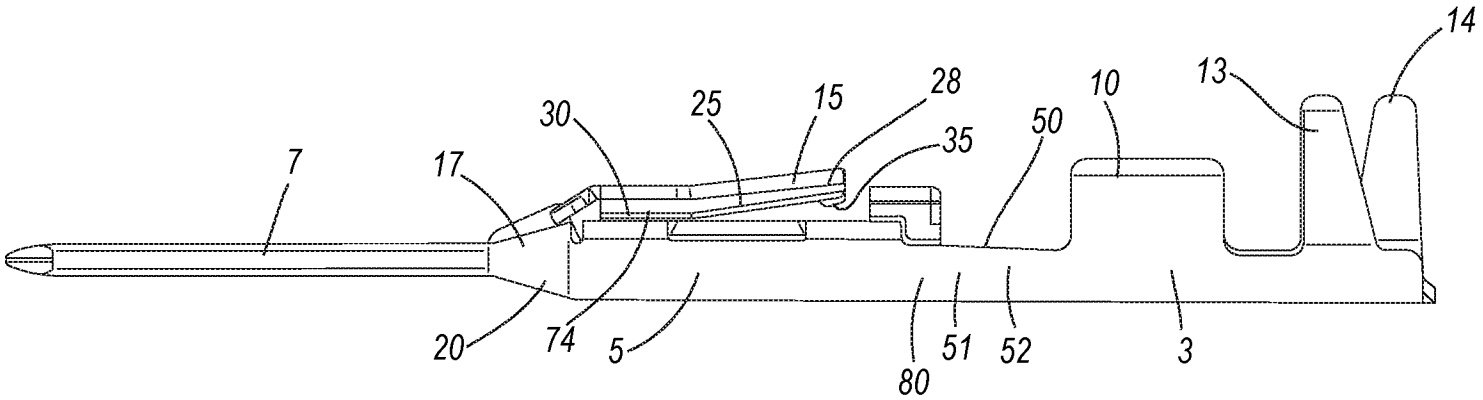
FIG. 2B is a left side elevational view of the electrical male terminal of this invention.

As illustrated in FIGS. 2A and 2B, the pair of wire-insulation clamping tabs or insulation crimp wing portions 13, 14 are not aligned when viewed at a side elevational view (that is, one of the pair, 13, 14 of wire-insulation clamping tabs or insulation crimp wings 13 is at a location that is closer to the wire-clamping tabs or core crimp wing portions 10, 11 compared to the location of one of the pair of wire-insulation clamping tabs or insulation crimp wing 14. As also illustrated in FIGS. 2A and 2B, the clamp or crimp area 3 integrally transitions to the main body 5 with a neck member 52, while the front end portion 20 of the main body 5 integrally transitions to the blade 7. As shown in FIG. 2A, the tang member 15 includes a lever member 25, the lever member 25 having an unattached end portion 28 and an attached end portion 30. As further seen in FIGS. 2A and 2B, the lever member 25, is shown here in a normal, relaxed state.

Figure 5A:
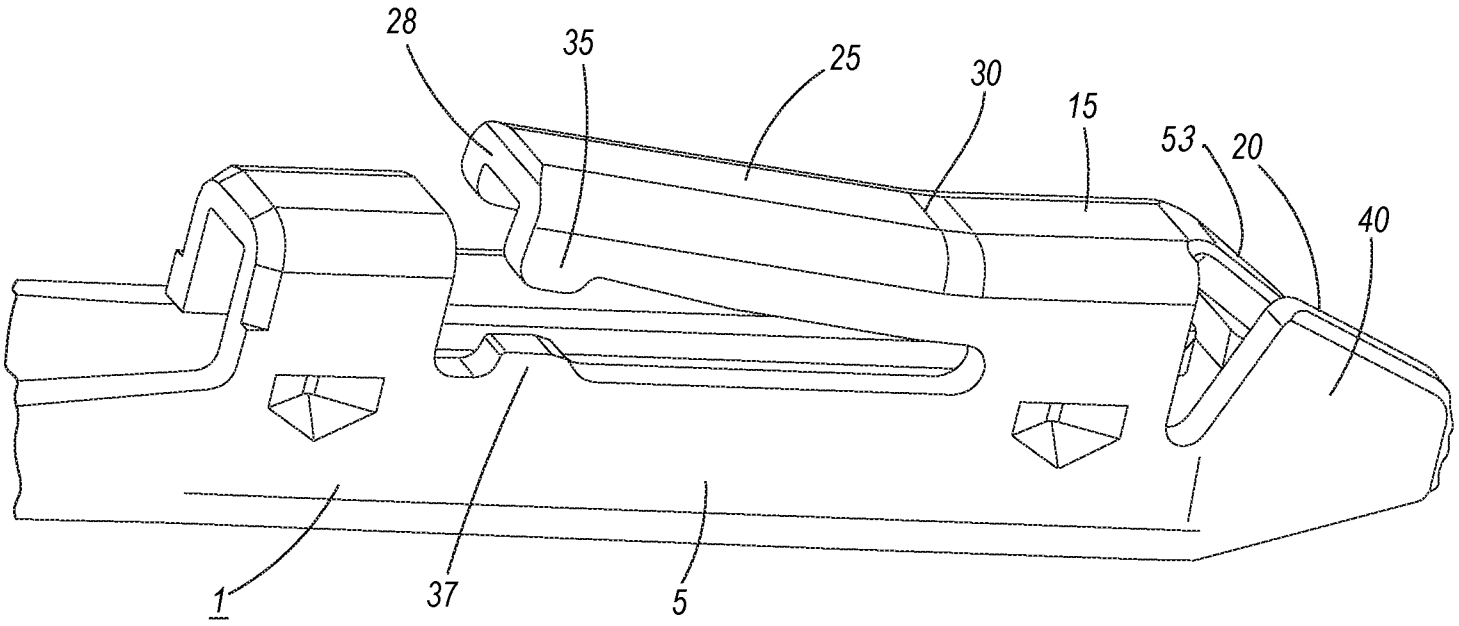
FIG. 5A shows the main body of the male terminal having the tang member, and further shows the guide and overstress protection structural arrangements or features of the male terminal.

The unattached end portion 28 of the lever member 25 preferably has, in a cross-section along a width thereof, a substantially U-shaped form or the like, although the form thereof is not restricted thereto (see, FIG. 5A). The attached end portion 30 of the lever member 25 preferably has, in a cross-section along a width thereof, a substantially L-shaped form or the like, although the form thereof is not restricted thereto (see, FIG. 8A).

Further, the lever member 25 has a protruding member 35, which meets another protruding member 37 that extends from the main body 5 (see, FIG. 2A). Both protruding members 35, 37 act as an overstress protection for the lever member 25. That is, the protruding members 35, 37 impinge against each other, when the lever member 25 is in a flexed state. This thereby prevents or protects the lever member 25 from becoming deformed when the male terminal 1 contacts or mates with a connector assembly 90 or the like (see, FIG. 14A). As such, the lever member 25 is operative to substantially move between a flexed state and a normal relaxed state without deformation (see, FIG. 14A, 14B). When seen at the side elevational views of FIGS. 2A and 2B, the protruding members 35, 37 are preferably substantially rectangular, round, trapezoid or the like, although the shape or form thereof is not restricted thereto.

Figure 14A:
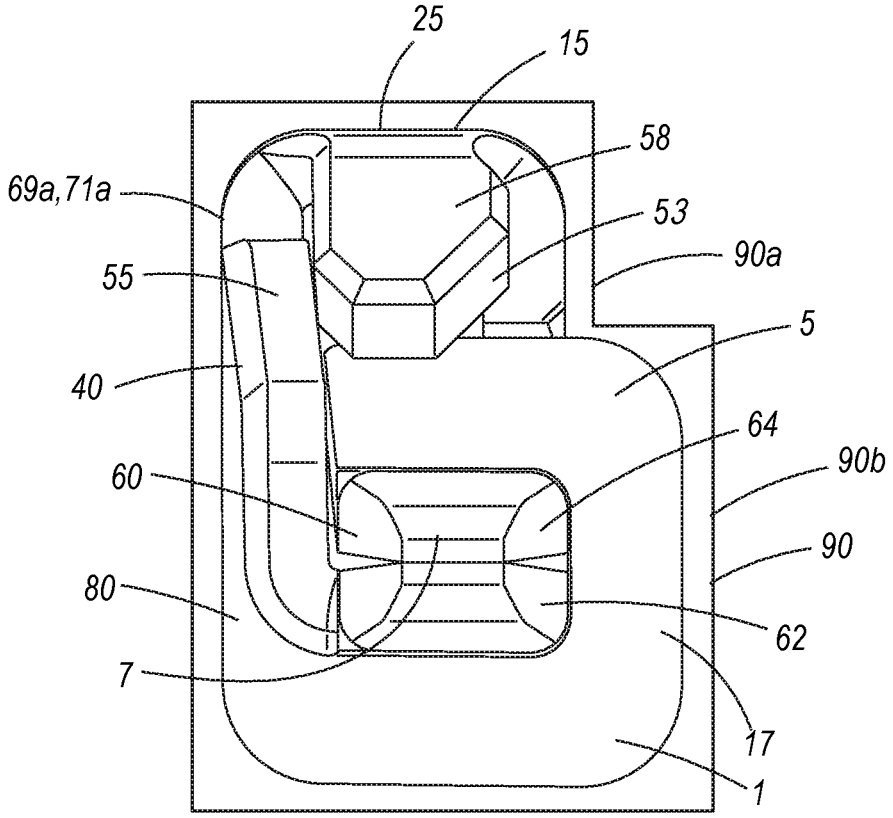
FIG. 14A shows a front elevational view of the electrical male terminal of this invention at pre-lock position within the connector assembly.

In operation, when the electrical male terminal 1 enters the connector assembly 90, the unattached end portion 28 of the lever member 25 is freely pushed downward and moves from the normal, relaxed state, into a flexed state (that is, the protruding member 35 approaches the another protruding member 37) (see, FIG. 14A). Upon full insertion of the electrical male terminal 1 into the connector assembly 90, the unattached end portion 28 of the lever member 25 freely moves upward, with the return to the normal, relaxed state of the lever member 25 (that is, the protruding member 35 moves away from the another protruding member 37) (see, FIGS. 2A, 14B). The unattached end portion 28 is thereby impinged onto a member (not shown) inside the connector assembly 90, locking and securing therein the electrical male terminal 1. Such a structural arrangement, which has the unattached end portion 28 of the lever member 25 impinged inside the connector assembly, acts as a locking and securing feature of the electrical male terminal 1.

Moreover, when the electrical male terminal 1 is fully inserted into the connector assembly 90, the clamp or crimp area 3 has a space or transition area 50, above neck member 52, (see FIGS. 2A, 2B) and between the wire-clamping tabs or core crimp wing portions 10, 11 and the main body 5. The space or transition area 50 is available for accommodating therein a terminal position assurance (TPA) device (not shown) for assuring that the male terminal 1 remains locked, secured, and correctly positioned within the connector assembly 90.

Also shown in FIG. 2A is a panel shield member 40 at the front end portion 20 of the main body 5, the panel shield member 40 protruding from a portion of the front end portion 20 of the main body. Further shown in FIG. 2B is the tapered portion 17 of the front end portion 20 of the main body 5. Together, the panel shield member 40 and the tapered portion 17 (and a protruding guide member 53, illustrated in FIGS. 6A and 6B, discussed later) assist in guiding and positioning the blade 7 and the main body 5 when mating the electrical male terminal 1 with the connector assembly 90.

Figure 3A:
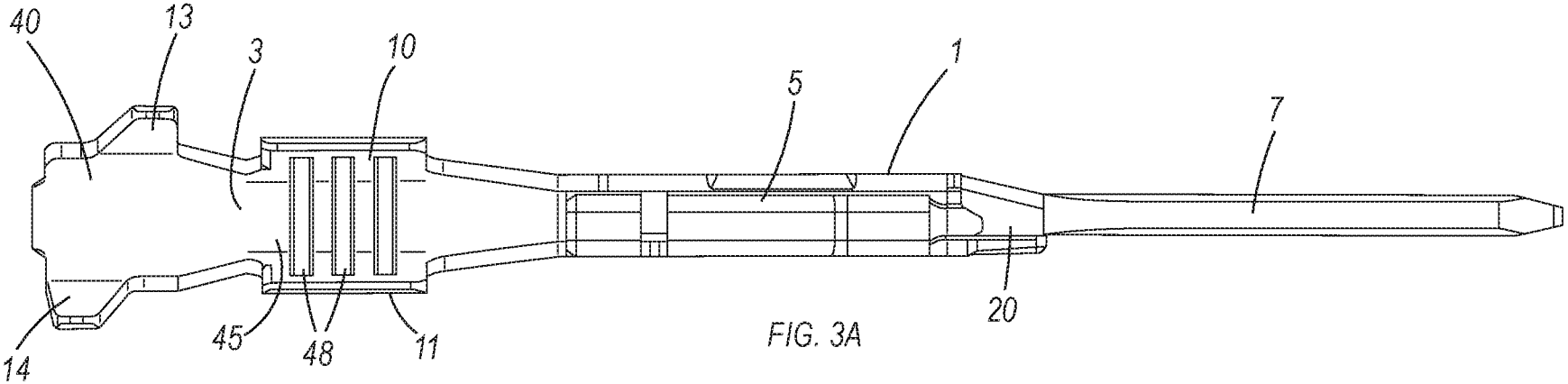
FIG. 3A is a top elevational view of the electrical male terminal of this invention.

The top elevational views of the clamp or crimp area 3, the main body 5, and the blade 7 are shown in FIG. 3A. As also shown in FIG. 3A, and previously discussed, the pair of wire-insulation clamping tabs or insulation crimp wing portions 13, 14 are unaligned, not directly aligned with, or substantially opposing each other. Further, as mentioned previously, the location of one of the pair of wire-insulation clamping tabs or insulation crimp wing portion 13 is nearer to the wire-clamping tabs or core crimp wing portions 10, 11 of the electrical male terminal 1 compared to the location of the other one of the pair of wire-insulation clamping tabs or insulation crimp wing portion 14. This is so as to maximize the surface area of the insulated portion 120 of the electrical wire or cable 100 onto which the pair of wire-insulation clamping tabs or insulation crimp wing portions 13, 14 connect and mount when clamped or crimped. As will be described later, another embodiment of electrical male terminal 1 is possible with a substantially directly opposed, or substantially symmetrical pair of foldable wire-insulation clamping tabs or insulation wing portions 213, 214 (see, FIGS. 12A and 12B). As seen in FIG. 9, between the pair of wire-insulation clamping tabs or insulation crimp wing portions 13, 14 is a floor member 40 for receiving thereon an insulated portion 120 of an electrical wire or cable 100. The pair of wire-insulation clamping tabs or insulation crimp wing portions 13, 14, after receiving the wire or cable 100, are deformed, clamped or folded and crimped onto the insulated portion 120 of the electrical wire or cable 100, without penetrating entirely through the insulated portion 120, or contacting the core portion 110 (see FIG. 11). Additionally, the shape of the floor member 40 is preferably substantially concave, or rounded (see FIG. 8B).

Also illustrated in FIG. 3A are the pair of wire-clamping pads or core crimp wing portions 10, 11, of clamp or crimp area 3. The pair of wire-clamping pads or core crimp wing portions 10, 11 are substantially aligned with or substantially opposing each other (see also, FIGS. 2A and 2B where the electrical male terminal 1 is viewed at an elevational side thereof) and are substantially symmetrical. Between the pair of wire-clamping tabs or core crimp wing portions 10, 11 is a floor member 45 having a plurality of notches 48. The shape of the floor member 45 may be substantially flat in shape (or substantially concave, rounded, as similar to that of the floor member 40). As shown in more detail, the floor 45 of the wire-clamping tabs or core crimp wing portions 10, 11 is substantially flat in shape (as illustrated in the cross-sectional view of FIG. 4C), although the floor 45 may alternatively be substantially concave, or rounded in shape (as similar to that of the floor member 40) (as illustrated in the cross-sectional view of FIG. 4D). Each of the plurality of notches 48 is substantially elongated in shape (as shown in FIGS. 2A, 2B, 4A, and 4B), but the shape of each of the notches 48 is not restricted thereto. A minimum of two notches 48 is possible, but at least three notches 48 are preferable. A minimum of one protruding member 60 is possible, but at least two protruding members 60 are preferable. The combination of the notches 48 and protruding members 60 creates a serration to the floor member 45 and pair of wire-clamping pads or core crimp wing portions 10, 11. This arrangement ensure a secure contact and grip between the floor member 45 and pair of wire-clamping pads or core crimp wing portions 10, 11 with a wire core portion 110 (see, FIG. 9) of the electrical wire or cable 100. Once the wire core is inserted, the clamp or crimp area 3 substantially grips the wire core portion 110 of the electrical wire or cable 100 so as not to slip away from the floor member 45 and pair of wire-clamping pads or core crimp wing portions 10, 11; the pair of wire-clamping tabs or core crimp wing portions 10, 11 are then additionally deformed, clamped or folded and crimped toward the floor member 45 onto the wire core portion 110 of the electrical wire or cable 100. This process ensures a secure contact and grip of the clamp or crimp area 3 of the electrical male terminal 1 with the wire core portion 110 of the electrical wire or cable 100 and prevents the wire core portion 110 of the electrical wire or cable 100 from slipping away from the male electrical terminal 1.

Figure 10:
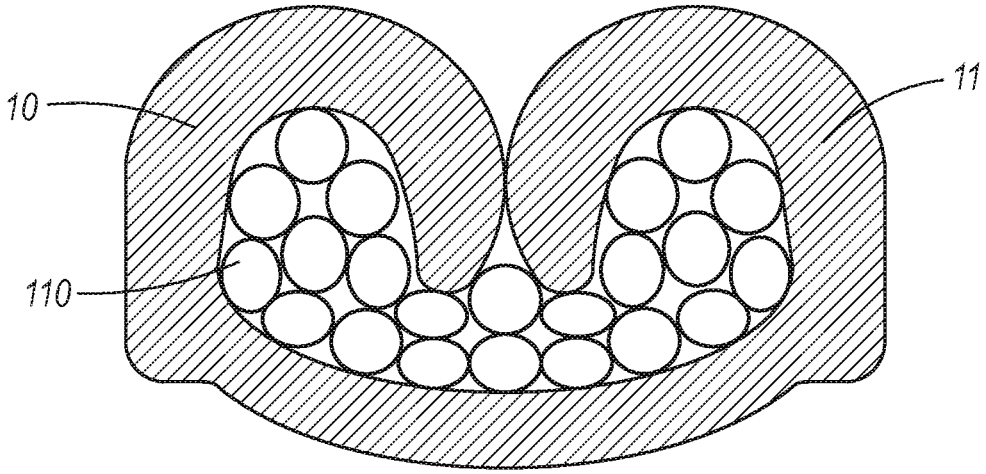
FIG. 10 shows a cross-sectional view of the manner in which the wire-clamping tabs or core crimp wing portions are folded over and deform into the wire core portion of the electrical wire or cable.

As illustrated in FIG. 10, the wire core portion 110 subsequently substantially conforms to the shape of the deformed, clamped or folded and crimped wire-clamping tabs or core crimp wing portions 10, 11. That is, when the pair of wire-clamping tabs or core crimp wing portions 10, 11 are deformed, clamped or folded and crimped (clamping or crimping process) onto the wire core portion 110 of the electrical wire or cable 100, protruding members 60 (see, FIGS. 4A and 4B) between the notches 48, as well as protruding members 68 at each end (see also, FIGS. 4A and 4B) dig into, or press into, the outer surface of the wire core portion 110 of the electrical wire or cable 100.

Figure 4A:
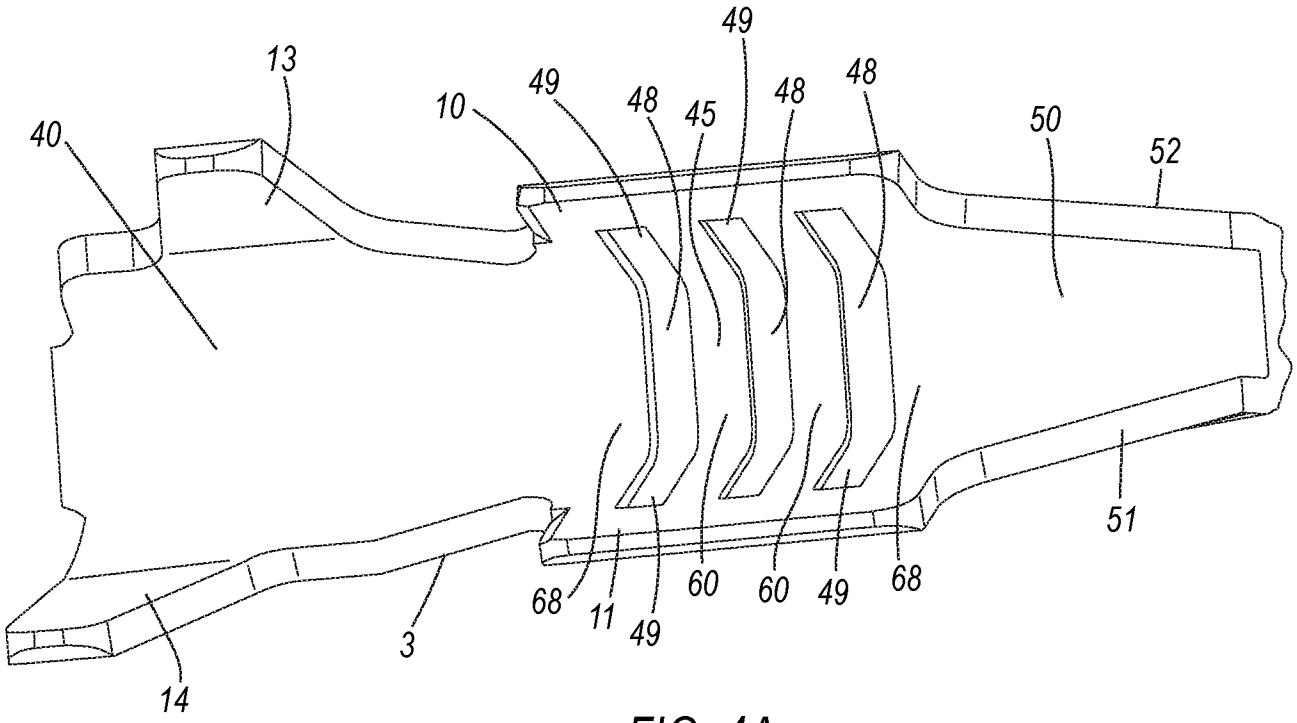
FIG. 4A shows a top elevational view of the clamp or crimp area having the pair of foldable wire-insulation clamping tabs or insulation crimp wing portions and the pair of wire-clamping tabs or core crimp wing portions, the latter having a plurality of substantially elongated notches that respectively extend substantially near the ends of the wire-clamping tabs or core crimp wing portions.

As further illustrated in FIG. 4A, each of the elongated notches 48 fully extend along the floor member 45 between the pair of wire-clamping tabs or core crimp wing portions 10, 11; and each of the elongated notches 48 further respectively partially extend, at end portions 49 thereof, into the pair of wire-clamping tabs or core crimp wing portions 10, 11 substantially near the ends thereof. Alternatively, an additional embodiment shown in FIG. 4B, has the end portions 49 of the elongated notches 48 respectively extending into the pair of wire-clamping tabs or core crimp wing portions 10, 11 and substantially exiting at and extending into the ends or tips thereof.

Figure 3B:
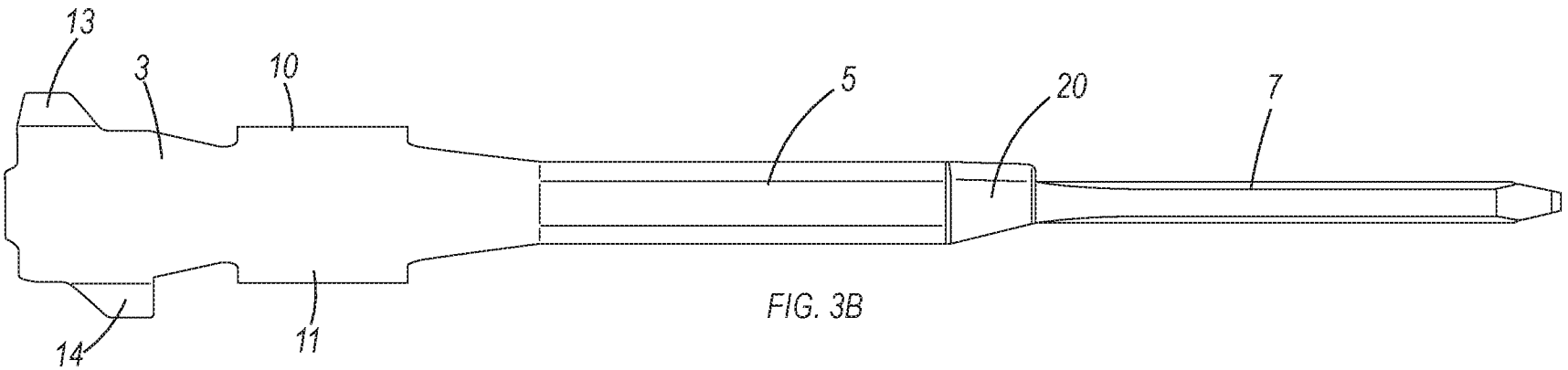
FIG. 3B is a bottom elevational view of the electrical male terminal of this invention.

Illustrated in FIG. 3B is the bottom elevational views of the clamp or crimp area 3, the main body 5, and the blade 7 of the electrical male terminal 1. The front end portion 20 of the main body 5 transitions the main body 5 to the blade 7 which is connected and integral thereto (FIG. 3B). Also shown in FIG. 3B are the pair of wire-clamping tabs or core crimp wing portions 10, 11, which are substantially symmetrical and respectively extend from the sides of the floor member 45 of the clamp or crimp area 3. The embodiment of electrical male terminal 1 shown in FIG. 3B displays the pair of wire-insulation clamping tabs or insulation crimp wing portions 13, 14, which are substantially unaligned, and is also evident when viewed at side elevational views thereof (see also, FIGS. 2A and 2B).

Figure 4B:
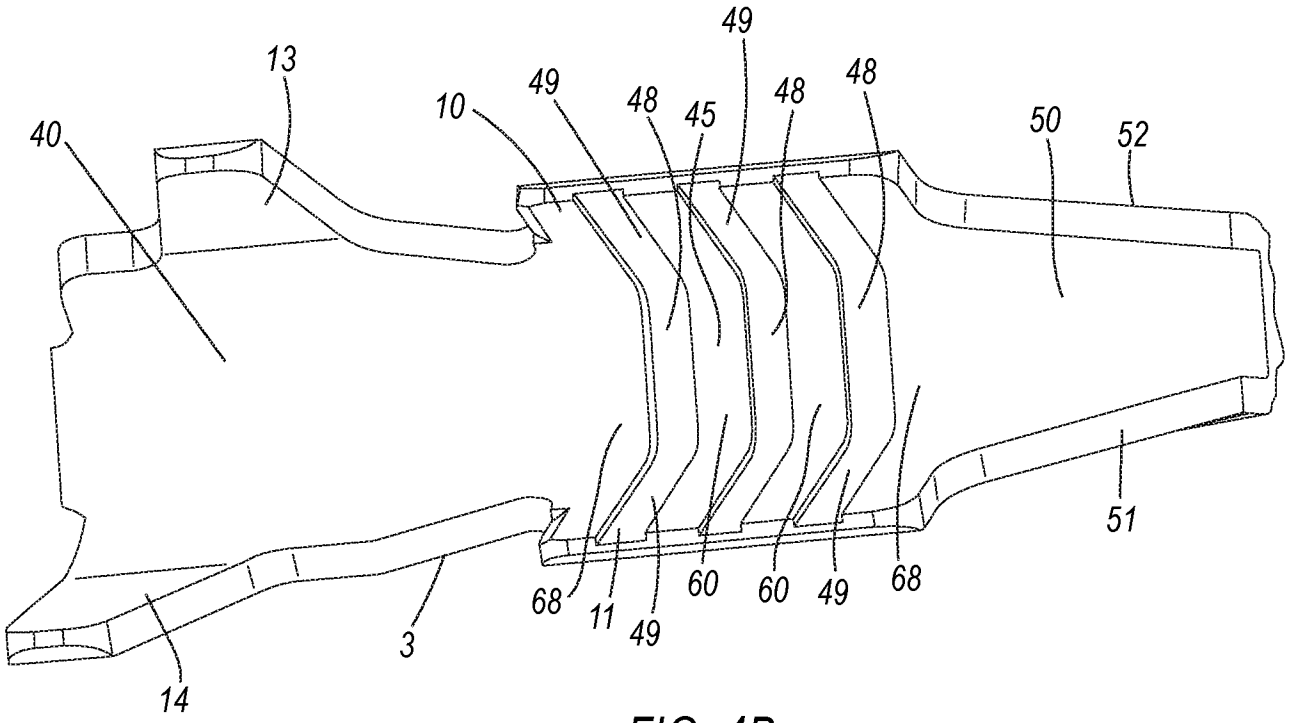
FIG. 4B shows a top elevational view of the clamp or crimp area having the pair of foldable wire-insulation clamping tabs or insulation crimp wing portions and the pair of wire-clamping tabs or core crimp wing portions, the latter having a plurality of substantially elongated notches that respectively extend to the ends of the wire-clamping tabs or core crimp wing portions.
Figure 4C:
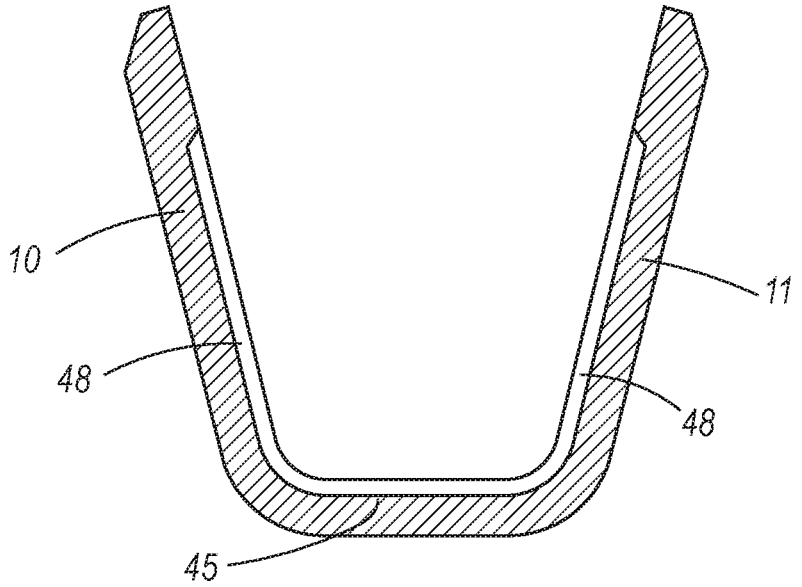
Figure 4D:
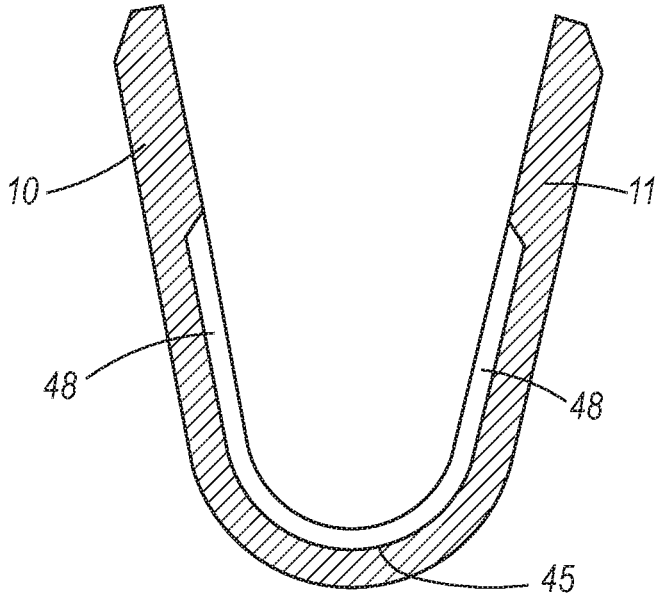
FIG. 4D shows a cross-sectional view of the floor of the wire-clamping tabs or core crimp wing portions as substantially concave, or rounded in shape.

Also illustrated in each of FIGS. 4A and 4B is a front portion 51 of the clamp or crimp area 3. The front portion 51 of the clamp or crimp area 3 includes a space or transition area 50 which is above a neck member 52 and between the main body 5 and the wire-clamping tabs or core crimp wing portions 10, 11. The neck member 52 has a narrowly tapered shape, narrowly tapering from the floor member 45, and the wire-clamping tabs or core crimp wing portions 10, 11, to where the neck member 52 meets the main body 5. Also, the narrowly tapered shape of the neck member 52 of the front portion 51 allows the wire core portion 110 of the electrical wire or cable 100 to remain seated or mounted within the floor member 45, and prevents the wire core portion 110 of the electrical wire or cable 100 from being seated or mounted, in its entirety, onto the neck member 52. Preferably, the narrowly tapered form of the neck member 52 of the clamp or crimp area 3 allows only a front portion of the wire core portion 110 of the electrical wire or cable 100 to protrude into the neck member 52. That is, the narrowly tapered form of the neck member 52 further prevents the wire core portion 110 from entering substantially into the space or transition area 50. The transition area 50 as described earlier, becomes available for accommodating therein the TPA device (not shown) for assuring that the male terminal 1 remains locked, secured, and correctly positioned when inserted within the connector assembly 90. Thus, wherein only a front portion of the wire core portion 110 enters or protrudes into the space or transition area 50, the wire core portion 110 will not interfere with or inhibit accommodating therein, of the TPA device (not shown).

Illustrated in FIG. 5A is the tang member 15 and the attached end 30 and unattached end portion 28 of the lever member 25. As discussed earlier with respect to FIGS. 2A and 2B, FIG. 5A also shows the protruding member 35 of the unattached end portion 28 of the lever member 25, which is capable of impinging against another protruding member 37 that extends from the main body 5 in preventing the lever member 25 from being deformed when the main terminal 1 is mated with the connector assembly 90. The just-described structural arrangement protects the lever member 25 from being overstressed (and thereby prevented from being deformed) when the lever member 25 is flexed when entering the connector assembly 90. Also shown in FIG. 5A is the panel shield member 40 of the front end portion 20 of the main body 5. The panel shield member 40 is discussed in more detail in FIGS. 6A and 6B.

Figure 5B:
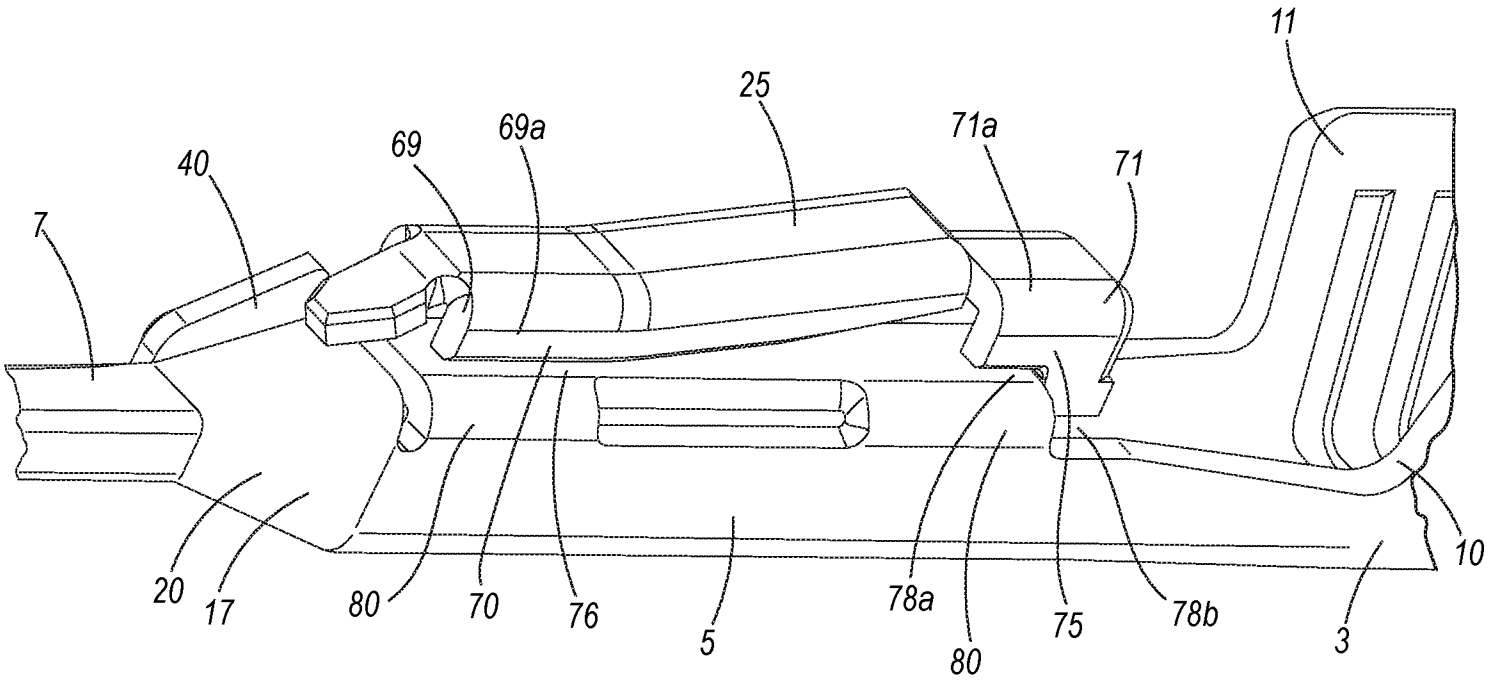
FIG. 5B shows a first support member and a second support member located at a front end portion and a back end portion, respectively, of the main body.

Illustrated in FIG. 5B are both the front and back portions 69, 71 of the main body 5 having a first support member 70 and a second support member 75, respectively. More particularly, an upper portion 69*a* at the front portion 69 of the main body 5 includes the first support member 70, while an upper portion 71*a* at the back portion 71 of the main body 5 includes the second support member 75. A gap 76 separates the first support member 70 from a lower portion 80 of the main body 5. A set of gaps 78*a*, 78*b* separate the second support member 75 from the lower portion 80 of the main body 5. When the electrical male terminal 1 enters the connector assembly 90, the first support member 70 and the second support member 75 are resiliently pushed downward toward the lower portion 80 of the main body 5 through the gaps 76, 78*a*/78*b*, respectively, located therebetween. With the above-described structural arrangements, the first and second support members 70, 75 provide the necessary resilience in preventing the electrical male terminal 1 of this invention from being overstressed and from being deformed when fitted into the connector assembly 90, thereby retaining polarity of the male terminal 1 (see, FIGS. 14A and 14B).

Figure 6A:
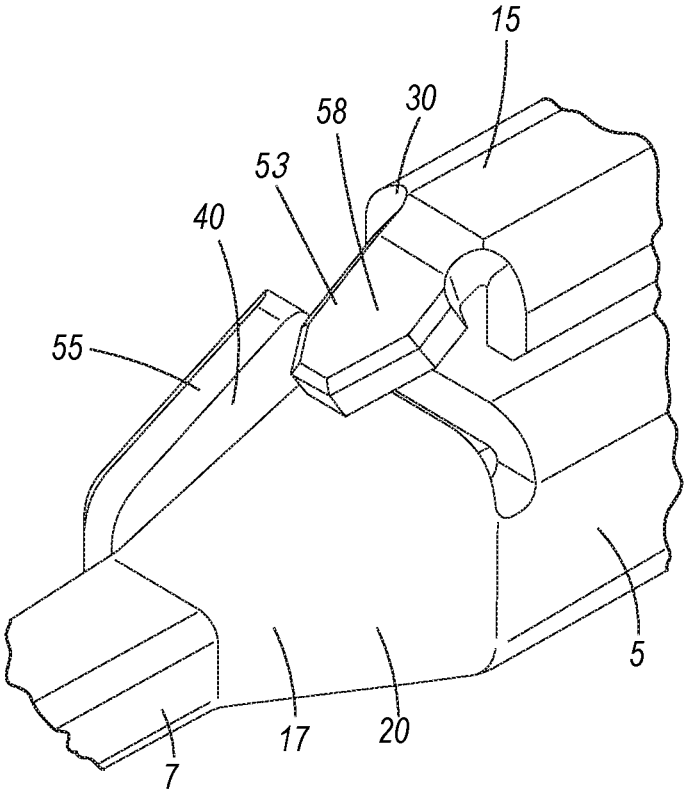
FIGS. 6A and 6B illustrate the tapered portion of the main body with a protruding guide member and a panel shield member for protecting the protruding guide member.
Figure 6B:
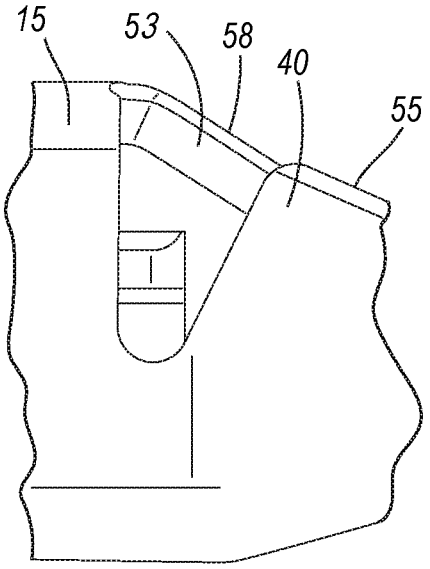

The panel shield member 40 is further illustrated in FIGS. 6A and 6B. The panel shield member 40 is illustrated herein as extending from a side portion of the front end portion 20 of the main body 5, although not limited thereto. The panel shield member 40 has an upper surface 55 and shown here at an incline, wherein the lower end of the upper surface 55 is toward the blade 7 and the upper end of upper surface 55 is toward the tang member 15.

Also shown in FIGS. 6A and 6B is a protruding guide member 53 that extends from and is attached to the tang member 15 of the main body 5. The panel shield member 40 protects the deformation of the protruding guide member 53 during, e.g., transport of the electrical male terminal 1 or preferably, when the electrical male terminal 1 is mated with and inserted into the connector assembly 90. As more particularly illustrated in FIG. 6B, it is preferred that an upper surface 55 extending, in its entirety, along the panel shield member 40 is substantially higher or equal in height to an upper surface 58 of the protruding guide member 53 (see, FIG. 6B). That is, it is preferable that the upper surface 55 of the panel guide member 40 is, in its entirety, higher than or equal to in height in comparison to the upper surface 58 of the protruding guide member 53. Likewise, the upper surface 58 of a portion of the protruding guide member 53 along the panel shield member 40, is lower than or equal to the upper surface 55 of the panel guide member 40, wherein the protruding guide member 53 substantially tapers from its attachment point with the tang member 15 substantially downward and toward the front end portion 20.

Figure 7:
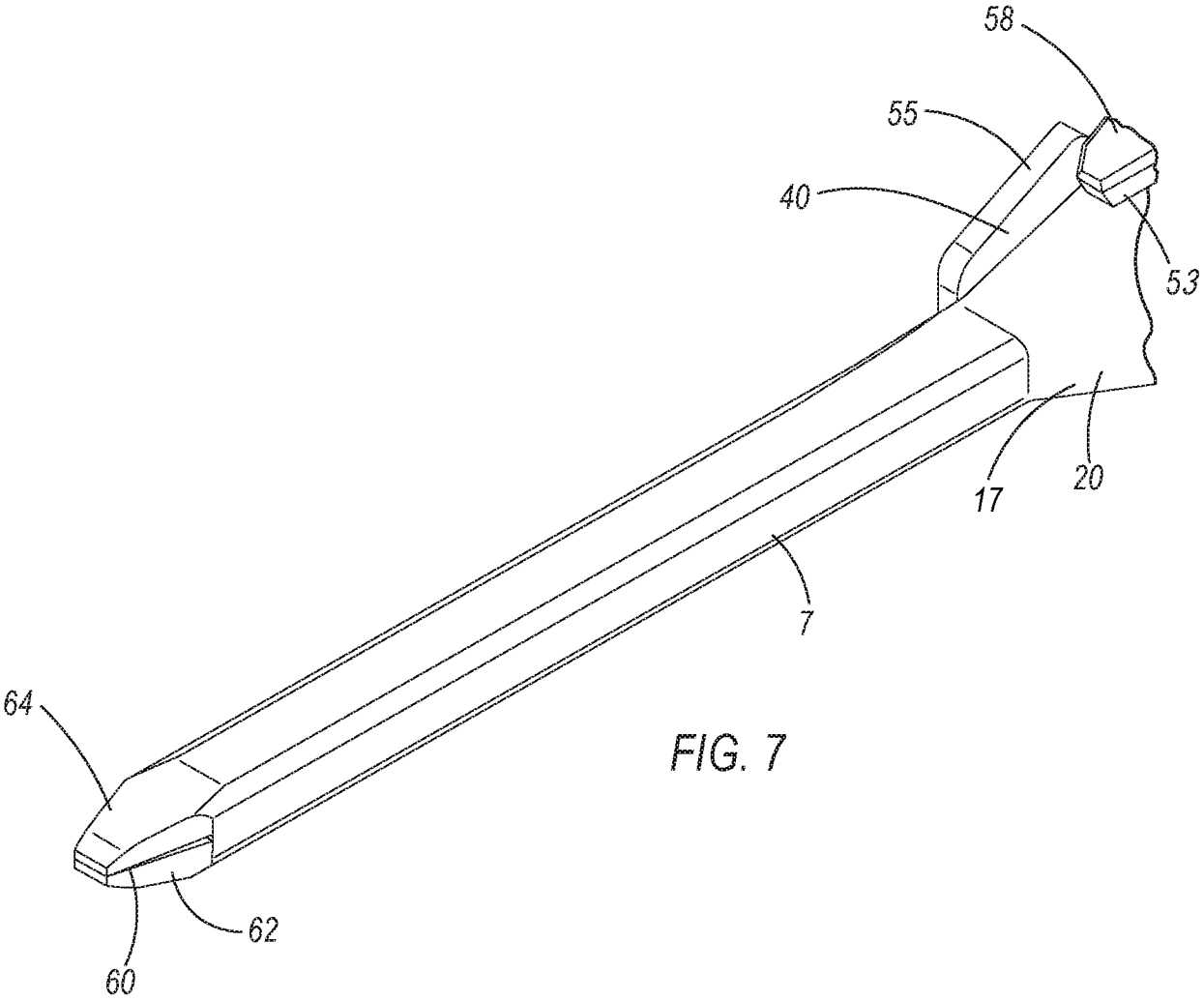
FIG. 7 shows the male blade extending from the tapered front end portion of the main body.

The front end portion 20 of the main body 5, as illustrated in FIG. 6A, transitions into the blade 7. The blade 7, as also shown in FIG. 7, acts as a male contact for the electrical male terminal 1 within the male connector assembly 90, and may be substantially rectangular, square, or the like in cross-sectional shape, although not limited thereto. At the end portion of the blade 7 is a tapered tip 60, which may include a lower portion 62 that is substantially symmetrical to an upper portion 64, but the lower portion 62 and upper portion 64 of the blade are not limited thereto so long as the tip 60 of the blade 7 is in a narrowly tapered form. The tapered tip 60 narrowly tapers toward the end of the blade 7, respectively, at the end of the electrical male terminal 1, and additionally acts to prevent stubbing or deformation of the blade 7.

Figure 8A:
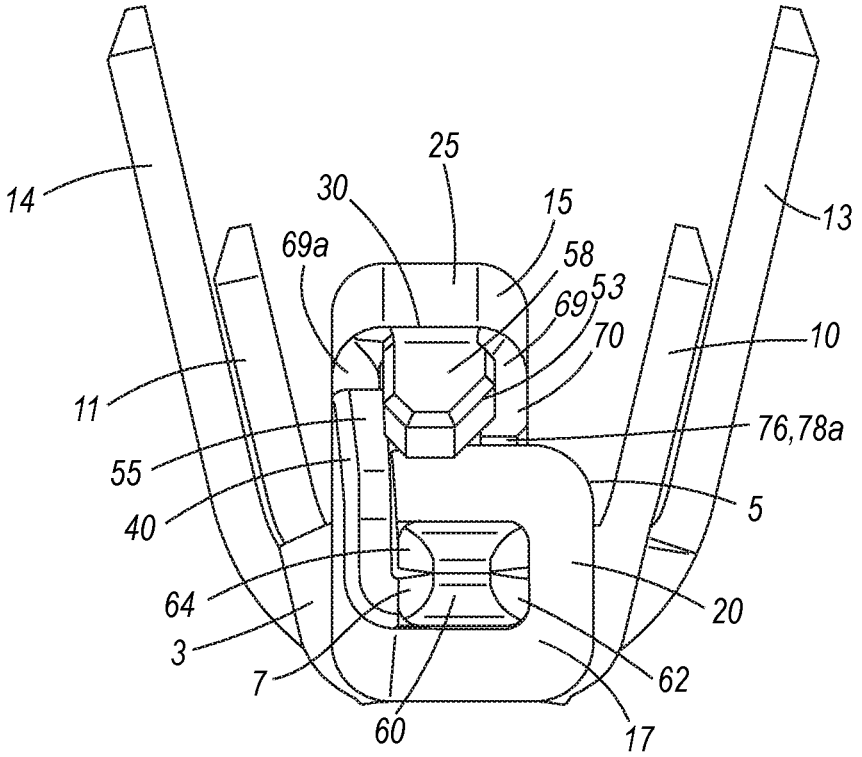

FIG. 8A is a front elevational view of the electrical male terminal 1. Shown here are the lower and upper portions 62, 64, and tip 60 of the blade 7 that extend from the main body 5. Also shown in FIG. 8A are the upper surface 55 of the panel shield member 40 having a height higher or equal (preferably in its entirety) along the upper surface 58 of the protruding guide member 53, the protruding guide member 53 extending from the tang member 15 of the main body 5. Shown also in FIG. 8A are the pair of wire-clamping tabs or core crimp wing portions 10, 11 and the pair of wire-insulation clamping tabs or insulation crimp wing portions 13, 14, both extending from the clamp or crimp area 3. Also seen in FIG. 8A are the gap 76 that separates the first support member 70 from the lower portion 80 of the main body 5, and similarly the gap 78*a* beneath the second support member 75 (see also, FIG. 5B).

Figure 8B:
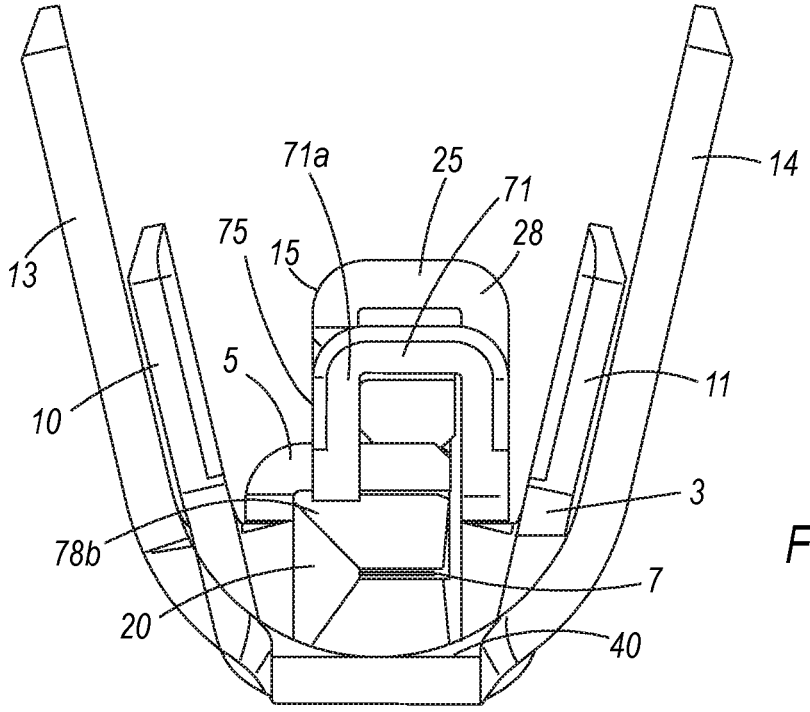
FIG. 8B is a back elevational view of the electrical male terminal of this invention.
Figure 9:
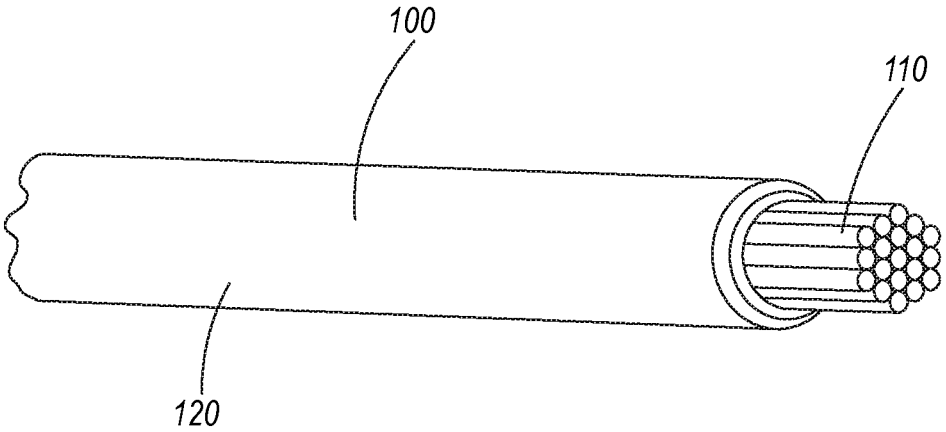
FIG. 9 shows a conventional electrical wire or cable for insertion into the male terminal of this invention, the conventional electrical wire or cable having an insulation portion and a wire core portion at a front portion thereof.

FIG. 8B shows the back elevational view of the electrical male terminal 1. Shown is the pair of wire-insulation clamping tabs or insulation crimp wing portions 13, 14 extending from respective sides of the floor member 40 of the clamp or crimp area 3. Also shown is the pair of wire-clamping tabs or core crimp wing portions 10, 11 extending from the floor member 45. As part of the main body 5, the second support member 75 is located, as shown, at the upper portion 71*a* of the back portion 71 of the main body 5 (see also, FIG. 5B). Also illustrated in FIG. 8B are the front end portion 20 of the main body 5, which transitions to the blade 7, and the substantially U-shaped unattached end portion 28 of the lever member 25.

FIG. 9 illustrates an exemplary electrical wire or cable 100 having the wire core portion 110 and the insulation portion 120, which is accommodated by the electrical male terminal 1 of this invention. Although not limited thereto, the wire core portion 110 of the electrical wire or cable 100 may rest onto the serrated portions (formed by the notches 48 and protruding members 60, 68; see, FIGS. 4A, 4B), and as discussed earlier, the floor member 45 and the pair of wire-clamping tabs or core crimp wing portions 10, 11 to provide a secure contact between the clamp or crimp area 3 of the electrical male terminal 1 and the wire core portion 110 of the electrical wire or cable 100; and when the pair of wire-clamping tabs or core crimp wing portions 10, 11 are deformed, clamped or folded and crimped onto the wire core portion 110 of the electrical wire or cable 100 (see, FIG. 10).

Moreover in FIG. 9, although not limited thereto, the insulation portion 120 of the electrical wire or cable 100 may rest onto the floor member 40 of the clamp or crimp area 3 of the electrical male terminal 1 (see FIGS. 4A, 4B); and the pair of wire-insulation clamping tabs or insulation crimp wing portions 13, 14 are clamped or folded and crimped onto the insulated portion 120 of the electrical wire or cable 100.

As discussed (see, FIGS. 4A and 4B), the pair of wire-clamping tabs or core crimp wing portions 10, 11 are clamped or folded and crimped onto the wire core portion 110 of the electrical wire or cable 100 (see, FIG. 10), and the pair of wire-insulation clamping tabs or insulation crimp wing portions 13, 14 are clamped or folded and crimped onto the insulated portion 120 of the electrical wire or cable 100 (see, FIG. 11); and the electrical male terminal 1 is then inserted into the connector assembly 90 or the like, as illustrated in FIG. 14A.

Shown in more detail in FIG. 10 is the orientation in which the pair of wire-clamping tabs or core crimp wing portions 10, 11 are folded towards each other, and the floor member 45, and are deformed, clamped or folded and crimped around and into the wire core portion 110 of the electrical wire or cable 100. Here, the wire core portion 110 of the electrical wire or cable 100 is essentially crushed, deformed, compacted, and substantially surrounded by the pair of wire clamping tabs or core crimp wing portions 10, 11.

Figure 11:
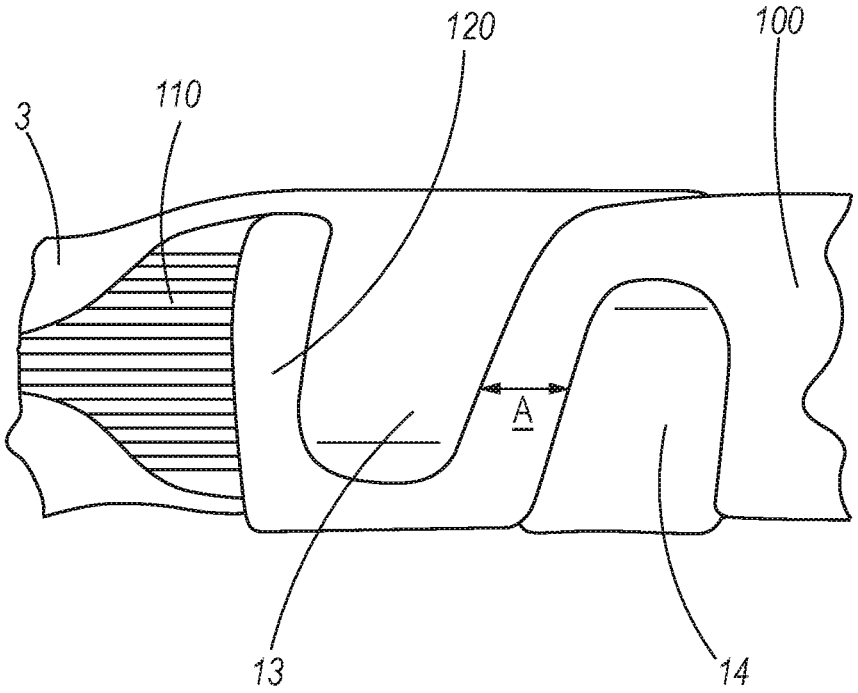
FIG. 11 is a side elevational view showing how the pair of foldable wire-insulation clamping tabs or insulation crimp wing portions is clamped or folded, and crimped onto the insulation portion of the electrical wire or cable.

FIG. 11 shows how the pair of foldable wire-insulation clamping tabs or insulation wing portions 13, 14 are clamped or folded towards floor 40 and crimped onto the insulated portion 120 of the electrical wire or cable 100. As further detailed in FIG. 11, when deformed, clamped or folded and crimped onto the insulation portion 120 of the electrical wire or cable 100, a gap A exists between an unaligned pair of the pair of foldable wire-insulation clamping tabs or insulation wing portions 13, 14. Alternatively, the pair of foldable wire-insulation clamping tabs or insulation wing portions 13, 14 may contact each other on one or more points when clamped or folded, and crimped onto the insulation portion 120 of the electrical wire or cable 100 (see, e.g., FIG. 11).

Figure 12A:
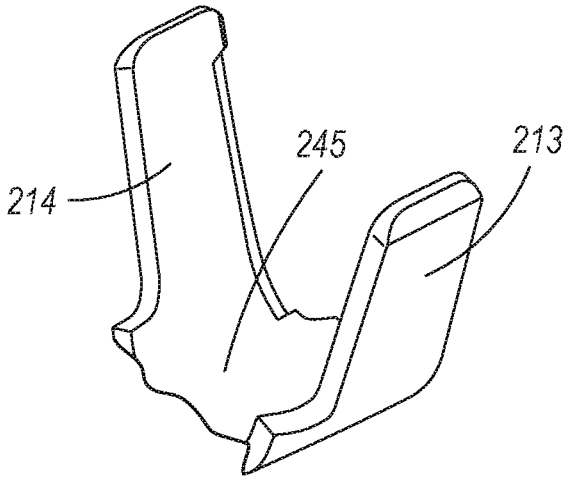
FIG. 12A is a perspective view and FIG. 12B is a top elevational view of another embodiment of a pair of foldable wire-insulation clamping tabs or insulation crimp wing portions, the pair of foldable wire-insulation clamping tabs or insulation crimp wing portions being substantially directly opposed to each other or substantially symmetrical to each other.
Figure 12B:
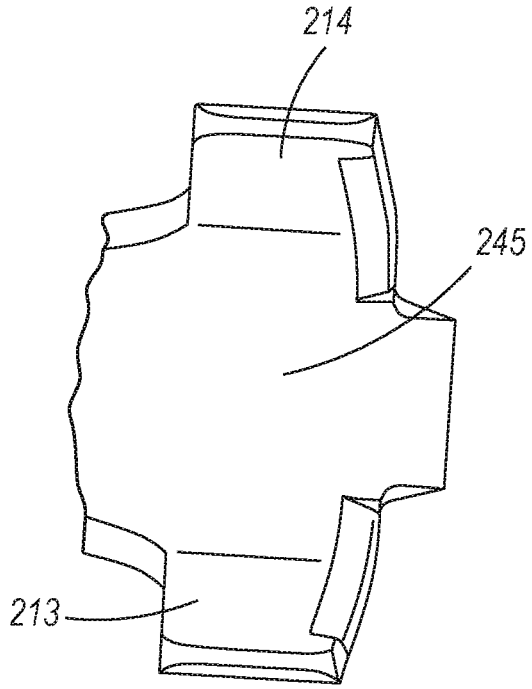
Figure 13:
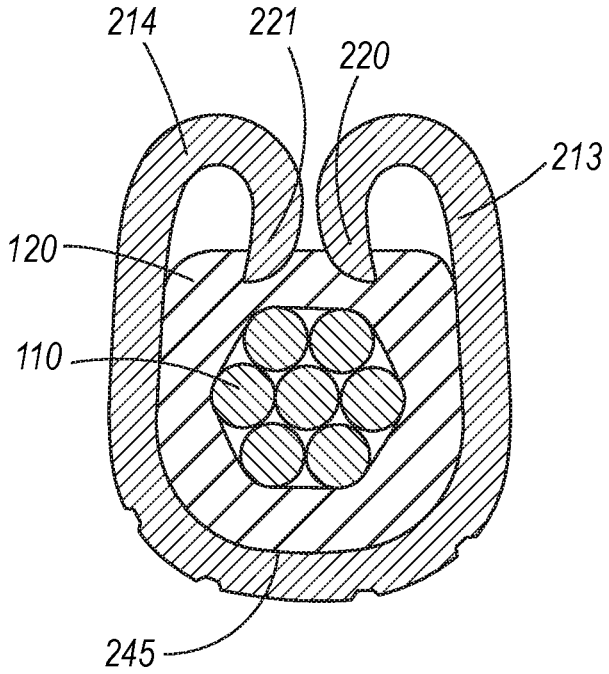
FIG. 13 is a cross-sectional view of the pair of the substantially opposed or substantially symmetrical foldable wire-insulation clamping tabs or insulation crimp wing portions, the ends of which are folded into the insulation portion of the electrical wire or cable.

As mentioned earlier, alternatively, another embodiment of the pair of foldable wire-insulation clamping tabs or insulation wing portions 213, 214 are shown in FIGS. 12A and 12B, wherein the pair of foldable wire-insulation clamping tabs or insulation wing portions 213, 214 are substantially aligned and directly opposed to each other, or substantially symmetrical to each other. The pair of foldable wire-insulation clamping tabs or insulation wing portions 213, 214, extends from a substantially concave or rounded floor member 245. After insertion of the insulated portion 120 of the electrical wire or cable 100, the pair of foldable wire-insulation clamping tabs or insulation wing portions 213, 214 are folded toward each other, and toward the floor 245, dig into the insulated portion 120 of the electrical wire or cable 100, as illustrated in FIG. 13. As further shown in FIG. 13, the end portions 220, 221 of the pair of foldable wire-insulation clamping tabs or insulation wing portions 213, 214, respectively, preferably penetrate into a portion of the insulation portion 120, but preferably do not penetrate entirely through the insulation portion 120, or contact the core portion 110, of the electrical wire or cable 100.

Illustrated in FIG. 14A is the electrical male terminal 1, in a pre-lock position, while being inserted into and through the connector assembly 90 or the like, the electrical male terminal 1 being shown in a front elevational view. Here the blade 7 is inserted first and enters the connector assembly 90, as understood, as the direction of mating of the electrical male terminal 1 with the respective connector assembly 90. Herein and before insertion commences, the pair of wire-clamping tabs or core crimp wing portions 10, 11 are deformed, clamped or folded and crimped onto the wire core portion 110 of the electrical wire or cable 100, and the pair of wire-insulation clamping tabs or insulation crimp wing portions 13, 14 are clamped or folded and crimped onto the insulation portion 120 of the electrical wire or cable 100. As discussed above in the elevational view of the electrical male terminal 1 in FIG. 8A, shown here also, in FIG. 14A, are the lower and upper portions 62, 64 and tapered tip 60 of the blade 7 that extends from the main body 5. Also shown is the upper surface 55 of the panel shield member 40 with its height (preferably in its entirety) higher or equal to the upper surface 58 of the protruding guide member 53. The protruding guide member 53 extends from the tang member 15 and above the front end portion 20. The lever member 25 here has been flexed downward by the connector assembly 90 which allows the electrical male terminal 1 main body 5 to be inserted there into upper portion 90*a* and guided into by protruding guide member 53 (see FIG. 14A).

Figure 14B:
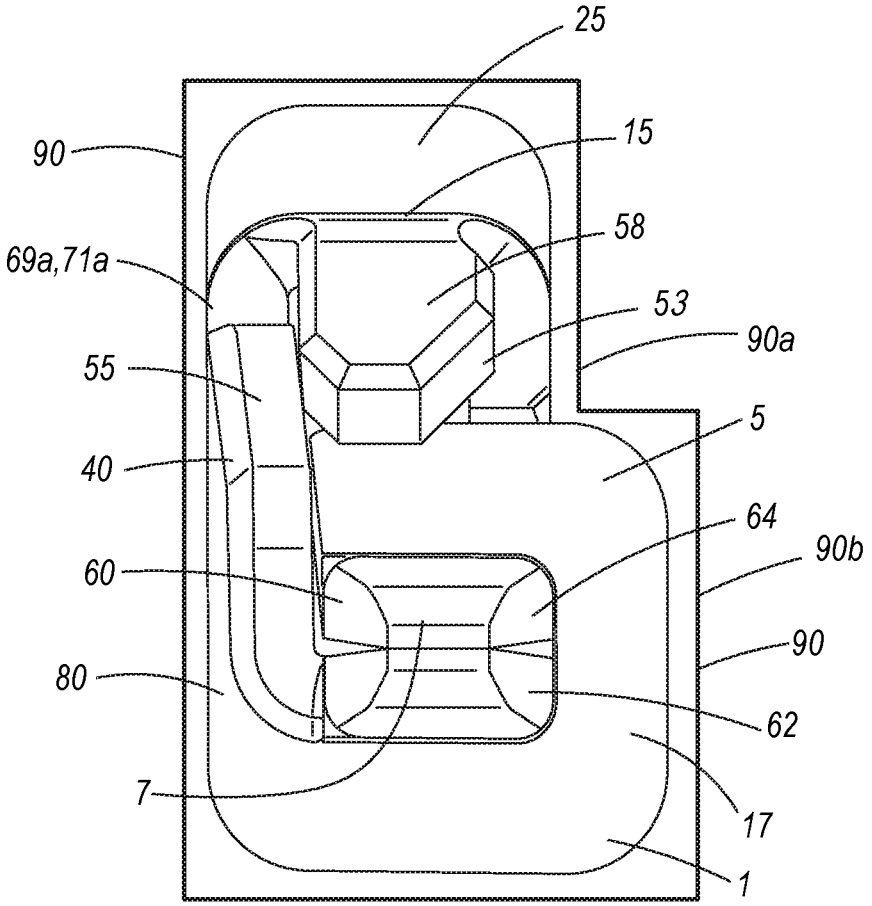
FIG. 14B shows a front elevational view of the electrical male terminal of this invention fully rested and at full-lock position within the connector assembly, FIGS. 14A and 14B further showing the polarities or orientations of the electrical male terminal of this invention and the corresponding connector assembly for effective fitting therewith.

As discussed earlier, and seen in FIG. 14A, during insertion of the electrical male terminal 1 into the connector assembly 90, the protruding members 35, 37 (see, e.g., FIGS. 2A and 5A) and the first and second support members 70, 75 (see, e.g., FIG. 5B) prevent or protect at least the lever member 25 and the male terminal 1 from becoming overstressed or deformed (see FIGS. 14A, 14B). Also, as discussed earlier, the tapered portion 17 of the front end portion 20 of the main body (see, e.g., FIG. 2A) and the protruding guide member 53 assist in guiding the male terminal 1 into the connector assembly 90 (see, FIG. 14A). The panel shield member 40 protects the protruding guide member 53 (see, e.g., FIGS. 6A and 6B), during the insertion of the electrical male terminal 1 into the connector assembly 90 (see, FIG. 14A).

FIG. 14B shows the fully inserted electrical male terminal into the connector assembly 90. As shown in FIG. 10B, the lever member 25 retracts upward to a normal relaxed state and is locked or secured at the unattached end portion 28 by a member (not shown) inside the connector assembly 90. After or at this time, as discussed earlier (see, e.g., FIG. 2A), the TPA device (not shown) is then accommodated within the space 50 above neck member 52 located between the clamp or crimp area 3 and the main body 5, and assures that the electrical male terminal 1 remains locked, secured, and correctly positioned within the connector assembly 90.

Also shown in more detail in FIGS. 14A and 14B are the upper portion 90*a* and a lower portion 90*b* of the connector assembly 90. The orientation or polarity of the male terminal 1 of this invention is such that when the electrical male terminal 1 of this invention is oriented, inserted, and fitted with the with connector assembly 90, with the blade 7 entering first, and respective front end portion 20 further entering, the upper portion 69*a* at a front portion 69 and the upper portion 71*a* at a back portion 71 of the main body 5 are respectively accommodated by an upper portion 90*a* of the connector assembly 90, while the lower portion 80 of the main body 5 is respectively accommodated by a lower portion 90*b* of the connector assembly 90. The upper portion 69*a* is guided into upper portion 90*a* by protruding guide member 52. The lower portion 80 is guided into the lower portion 90*b* by the tapered portion 17 and panel shield member 40. The structural orientation or polarity shown in FIGS. 14A and 14B of the electrical male terminal 1 of this invention are such that the upper portions 69*a*, 71*a* of the main body 5, will reside or fit within the narrower upper portion 90*a*. Further, here the upper portion 69*a* and upper portion 71*a* are offset to one side in comparison to the lower portion 80 of the main body 5. The lower portion 80 is wider than the upper portions 69*a*, 71*a* and resides within the wider lower portion 90*b* of the electrical male terminal 1. However, such structural orientations or polarities of the electrical male terminal 1 of this invention, when inserted or fitted into the connector assembly 90 are not limited thereto. That is, when the electrical male terminal 1 of this invention is oriented, inserted, and fitted with connector assembly 90, with the with the blade 7 entering first, and respective front end portion 20 further entering, it may have the upper portions 69*a*, 71*a* of the main body 5 and the upper portion 90*a* of the connector assembly 90 being wider in comparison to the lower portion 80 of the main body 5 and the lower portion 90*b* of the connector assembly 90. And similarly, the upper portion 69*a* and upper portion 71*a* may be centered, or offset compared to the lower portion 80 of the main body 5 while fitted in the direction of mating, with the blade 7 entering first into the connector assembly 90. The polarity or orientation of the electrical male terminal 1 and connector assembly 90 will be substantially similar to allow a substantial fitment thereby together.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

We claim:

1. An electrical male terminal for insertion into a connector assembly, said electrical male terminal, comprising:

a clamp or crimp area, said clamp or crimp area having a pair of wire-clamping tabs or core crimp wing portions and a pair of wire-insulation clamping tabs or insulation crimp wing portions, said clamp or crimp area having a plurality of notches extending on at least a floor member between said pair of wire-clamping tabs or core crimp wing portions;

a main body attached to said clamp or crimp area, said main body having a tang member and a tapered portion; and a blade extending from said main body, wherein said main body further includes a protruding guide member, and a panel shield member that shields said protruding guide member upon entry of the electrical male terminal into said connector assembly, and wherein an upper surface extending, in its entirety, along said panel shield member is substantially higher or substantially equal in height to an upper surface of said protruding guide member.

2. The electrical male terminal according to claim 1, wherein an upper surface extending, in its entirety, along said panel shield member is substantially higher or equal in height to an upper surface of said protruding guide member.

3. The electrical male terminal according to claim 1, wherein said tang member is comprised of a lever member, said lever member having an unattached end portion and an attached end portion.

4. The electrical male terminal according to claim 3, wherein said unattached end portion is substantially U-shaped in cross-section, and wherein said attached end portion is substantially L-shape in cross-sectio).

5. The electrical male terminal according to claim 4, wherein said unattached end portion of said lever member includes a first protrusion member extending therefrom, and wherein said main body includes a second protrusion member extending therefrom, said first and second protrusion members substantially contacting each other when said lever member moves downward upon entry of said male terminal into said connector assembly.

6. The electrical male terminal according to claim 1, wherein said main body includes a support member at either end thereof.

7. The electrical male terminal according to claim I, wherein said blade has a shape that is substantially rectangular or substantially square in cross-section.

8. An electrical male terminal for insertion into a connector assembly, said electrical male terminal comprising a clamp or crimp area, said crimp area having a pair of wire-clamping tabs or core crimp wing portions and a pair of wire-insulation clamping tabs or insulation crimp wing portions; a main body attached to said clamp or crimp area; and a blade extending from said main body, said main body including a protruding guide member and a panel shield member that shields said protruding guide member upon entry of the electrical male terminal into said connector assembly, wherein an upper surface extending, in its entirety, along said panel shield member is substantiall higher or substantially equal in height to an upper surface of said protruding guide member, wherein an upper portion of said electrical male terrain, and a lower portion of said electrical male terminal fit into an upper portion of said connector assembly and a lower portion of said connector assembly, respectively, when said electrical male terminal is fitted into said connector assembly, the widths of said upper and lower portions of said electrical male terminal being different.

9. The electrical male terminal for insertion into said connector assembly according to claim 8, wherein orientations or polarities of said electrical male terminal and said connector assembly are such that the width of an upper portion of a main body of said electrical male terminal being fitted into said upper portion of said connectorassembly is narrower than the width of a lower portion of said main body being fitted into said lower portion of said connector assembly.

10. The electrical male terminal for insertion into said connector assembly according to claim 8, wherein an upper surface extending, in its entirety, along said panel shield member is substantially higher or equal in height to an upper surface of said protruding guide member.

11. The electrical male terminal for insertion into said connector assembly according to claim 8, wherein said main body includes a lever member and a tapered portion, said lever member having an unattached end portion and an attached end portion, and wherein said unattached end portion of said lever member includes a first protrusion member extending therefrom, and wherein said main body includes a second protrusion member extending therefrom, said first and second protrusion members substantially contacting each other when said lever member moves downward upon entry of said male terminal into said connector assembly to prevent said male terminal from being overstressed and from being deformed when fitted into said connector assembly.

12. The electrical male terminal for insertion into said connector assembly according to claim 8, wherein said main body includes a support member at either end thereof, said support member at either end of said main body provides resilience at either end of said main body, thereby preventing said electrical male terminal from being overstressed and from being deformed when fitted into said connector assembly.

* * * * *